US006260779B1

(12) United States Patent
Gross et al.

(10) Patent No.: US 6,260,779 B1
(45) Date of Patent: Jul. 17, 2001

(54) AGITATOR MILL

(75) Inventors: Horst Gross, Lampertheim; Wendelin Kneisl, Ilvesheim, both of (DE)

(73) Assignee: Draiswerke GmbH, Mannheim (DE)

( * ) Notice: Subject to any disclaimer, the term of this patent is extended or adjusted under 35 U.S.C. 154(b) by 0 days.

(21) Appl. No.: 09/383,419

(22) Filed: Aug. 26, 1999

(30) Foreign Application Priority Data

Aug. 28, 1998 (DE) ..... 198 39 210

(51) Int. Cl.[7] ..... B02C 17/16
(52) U.S. Cl. ..... 241/171; 241/172
(58) Field of Search ..... 241/171, 172

(56) References Cited

U.S. PATENT DOCUMENTS 4,739,936 4/1988 Stehr .
5,544,825 8/1996 Stehr .
5,624,080 4/1997 Stehr et al. .
5,758,833 6/1998 Kabbe .

*Primary Examiner*—Mark Rosenbaum
(74) *Attorney, Agent, or Firm*—Browdy and Neimark

(57) ABSTRACT

An agitator mill comprises a cylindrical grinding receptacle, in which is disposed an agitator to be driven in rotation. At one end a grinding-stock supply line opens into the grinding chamber. At the other end a grinding-stock discharge line discharges therefrom. An auxiliary-grinding-body return line is provided, which discharges from the grinding chamber in an area of high local pressure and opens into the grinding chamber in an area of low local pressure, namely separate from the grinding-stock supply line.

12 Claims, 5 Drawing Sheets

AGITATOR MILL

BACKGROUND OF THE INVENTION

1. Field of the Invention

The invention relates to an agitator mill.

2. Background Art

U.S. Pat. No. 4,496,106 teaches, in an agitator mill with a cylindrical agitator, to supply the grinding stock concentrically from below and to discharge it upwards through an annular gap separating device. Auxiliary-grinding-body circulation takes place by external recirculation, the auxiliary grinding bodies being again supplied to the grinding stock supply line, i.e. they are supplied to the grinding-stock receptacle centrically from below together with the grinding stock. Experience has shown that the circulation of the auxiliary grinding bodies is irregular in this case.

SUMMARY OF THE INVENTION

It is an object of the invention to embody an agitator mill with external auxiliary-grinding-body circulation, in which regular and stable circulation of the auxiliary grinding bodies takes place.

According to the invention, this object is attained in an agitator mill comprising a grinding receptacle, a cylindrical wall and a lid and a bottom of which define a grinding chamber to be filled with auxiliary grinding bodies; an agitator, which is disposed in the grinding receptacle and has an agitator shaft and agitator elements mounted thereon; a drive motor for driving the agitator in rotation about an axis; a grinding-stock supply line, which is disposed at least in vicinity to the lid or to the bottom and opens into the grinding chamber; a grinding-stock/auxiliary-grinding-body separating device, which is disposed at least in vicinity to the bottom or the lid and opens into a grinding-stock discharge line; and an auxiliary-grinding-body return line, which is separate from the grinding-stock supply line, and which comprises an outlet from the grinding chamber in the vicinity of the cylindrical wall and neighboring the separating device, and which comprises an inlet into the grinding chamber radial to the axis in vicinity to the agitator shaft and neighboring the inlet of the grinding-stock supply line in the direction of the axis. Surprisingly, especially stable auxiliary-grinding-body circulation can be found whenever the auxiliary-grinding-body return line discharges from the grinding chamber in a portion of higher local pressure and opens into the grinding chamber in a portion of partial local vacuum. The pressure difference between the outlet and the inlet of the auxiliary-grinding-body return line furnishes the power and thus the actuation for a continuous and regular return of auxiliary grinding bodies (together with part of the grinding stock) through the auxiliary-grinding-body return line. Due to the fact that the auxiliary-grinding-body return line and in particular the inlet thereof into the grinding chamber is separate from the grinding-stock supply line, the low pressure which forms in the proximity of the agitator shaft in the grinding chamber can arise at the inlet. Since the grinding stock is supplied by means of a pump through the grinding-stock supply line, a correspondingly higher pressure prevails there, which would oppose the described effect in the case of a common insertion of fresh grinding stock and returned auxiliary grinding bodies. The inlet of the auxiliary-grinding-body return line into the grinding chamber is situated on the one hand as close as possible to the agitator shaft radially to the axis of the agitator shaft and on the other hand at the end of the grinding chamber into which opens the grinding-stock supply line.

Further features, details and advantages of the invention will become apparent from the ensuing description of four exemplary embodiments of the invention, taken in conjunction with the drawing.

DESCRIPTION OF THE PREFERRED EMBODIMENTS

Figure 1:
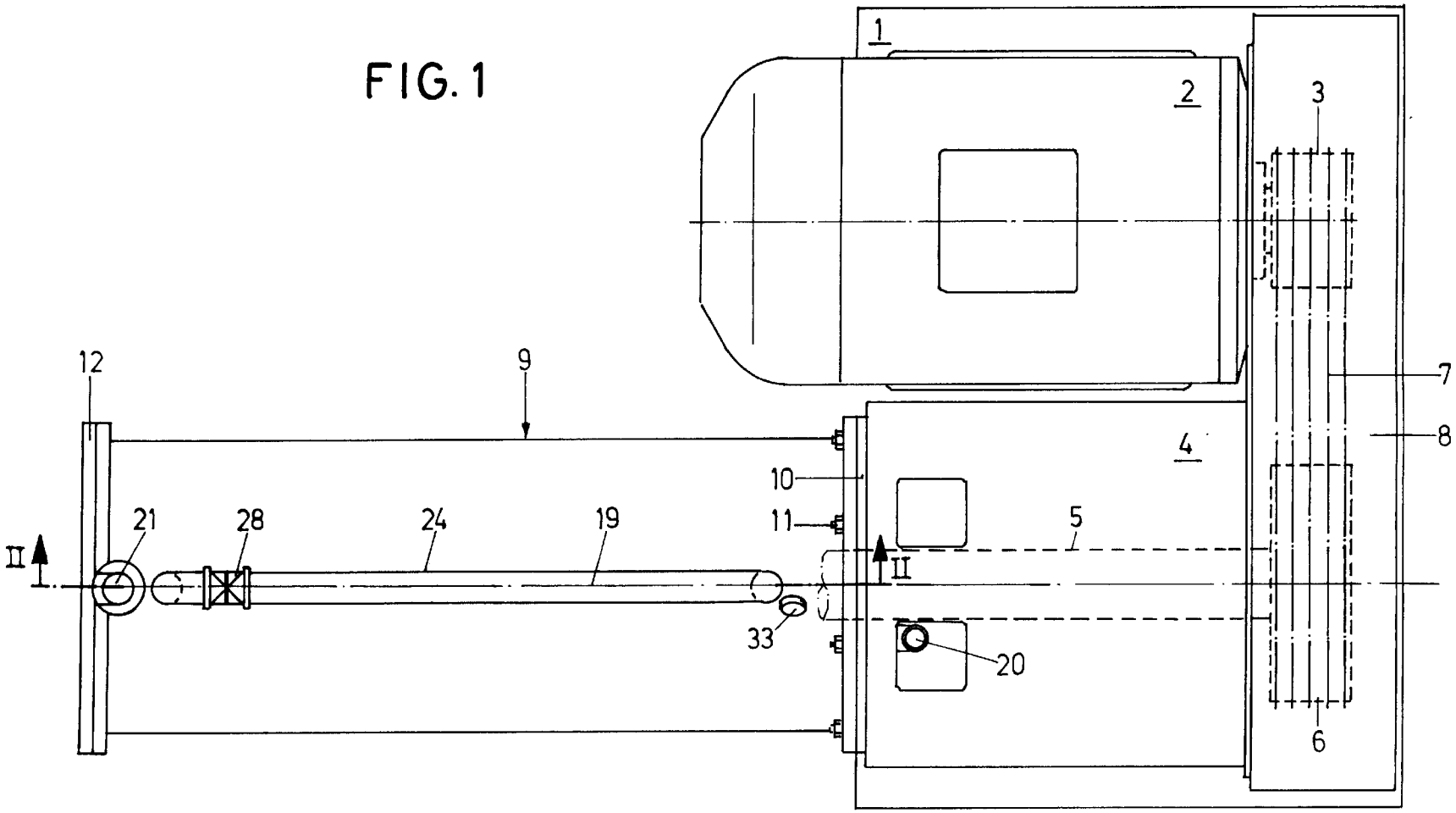
FIG. 1 is a plan view of a first embodiment of an agitator mill corresponding to the arrow I in FIG. 2.

The embodiments illustrated in FIGS. 1 to 5 deal with a so-called horizontal agitator mill. It has a machine stand 1 which is substantially formed by a base plate and which supports itself on the ground. A drive motor 2, speed-variable if required and provided with a V-belt pulley 3 is accommodated on this stand 1. Beside the drive motor 2, provision is made on the stand 1 for a bearing housing 4 in which a drive shaft 5 is rotatably run. The end of the drive shaft 5 that neighbors the V-belt pulley 3 is likewise provided with a V-belt pulley 6 which, by way of V-belts 7, is in driving connection with the V-belt pulley 3 of the drive motor 2. The V-belt pulleys 3, 6 and the V-belts 7 are provided with a cover 8.

By means of threaded bolts 11, the lid 10 of a cylindrical grinding receptacle 9 is fixed to the end, turned away from the V-belt pulley 6, of the bearing housing 4. At its end turned away from the bearing housing 4, the grinding receptacle 9 is closed by means of a bottom 12. An agitator 14 is disposed in an inner chamber, forming a grinding chamber 13, of the grinding receptacle 9 and has an over-mounted agitator shaft 15 which is joined against rotation to the drive shaft 5. This agitator shaft 15 is provided with agitator elements 16 formed by agitator disks 17 with admission ports 18. The agitator shaft 15, the drive shaft 5 and the grinding receptacle 9 have a joint axis 19. A grinding-stock supply line 20, through which grinding stock to be treated is supplied to the grinding chamber 13 by means of a pump 20*a*, passes through the lid 10 to open into the grinding chamber 13. In the vicinity of the bottom 12, a grinding stock discharge line 21, through which finished grinding stock is delivered, discharges from the grinding chamber 13. Allocated to this discharge line 21 is at least one separating device 22 which as a rule is a so-called screen cartridge projecting into the grinding chamber 13 in the space between the bottom 12 and the nearest neighboring agitator disk 17. Such screen cartridges have a design that is know from instance U.S. Pat. No. 3,780,957 and U.S. Pat. No. 4,739,936. The grinding chamber 13 is filled with auxiliary grinding bodies 23 to a considerable extent, for example by 70 to 90 percent. The separating device 22 is design ed in such a way that these auxiliary grinding bodies 23 cannot get into the discharge line 21.

In as much as the agitator mill has been described so far, it is substantially known from U.S. Pat. No. 5,758,833, to which reference is made for further details.

All the embodiments comprise an auxiliary-grinding-body return line 24, which discharges from the grinding chamber 13 in vicinity to the separating device 22 and which opens again into the grinding chamber in vicinity to the grinding-stock supply line 20. The inlet 25 is situated in the proximity of the agitator shaft 15, i.e. in the vicinity of local negative pressure. The outlet 26 of the return line 24 is located in the wall 27 of the grinding receptacle 11, i.e. on the periphery of the grinding chamber 13 and consequently in the vicinity of local excess pressure. This helps achieve an especially good and efficient circulation of the auxiliary grinding bodies 23 from the area of grinding-stock supply to the area of the separating device 22 and back again to the area of grinding-stock supply. Provided in the return line 24 may be a stop valve 28 for partially or entirely blocking the return line 24 and by means of which the degree of auxiliary-grinding-body circulation may be influenced.

Figure 2:
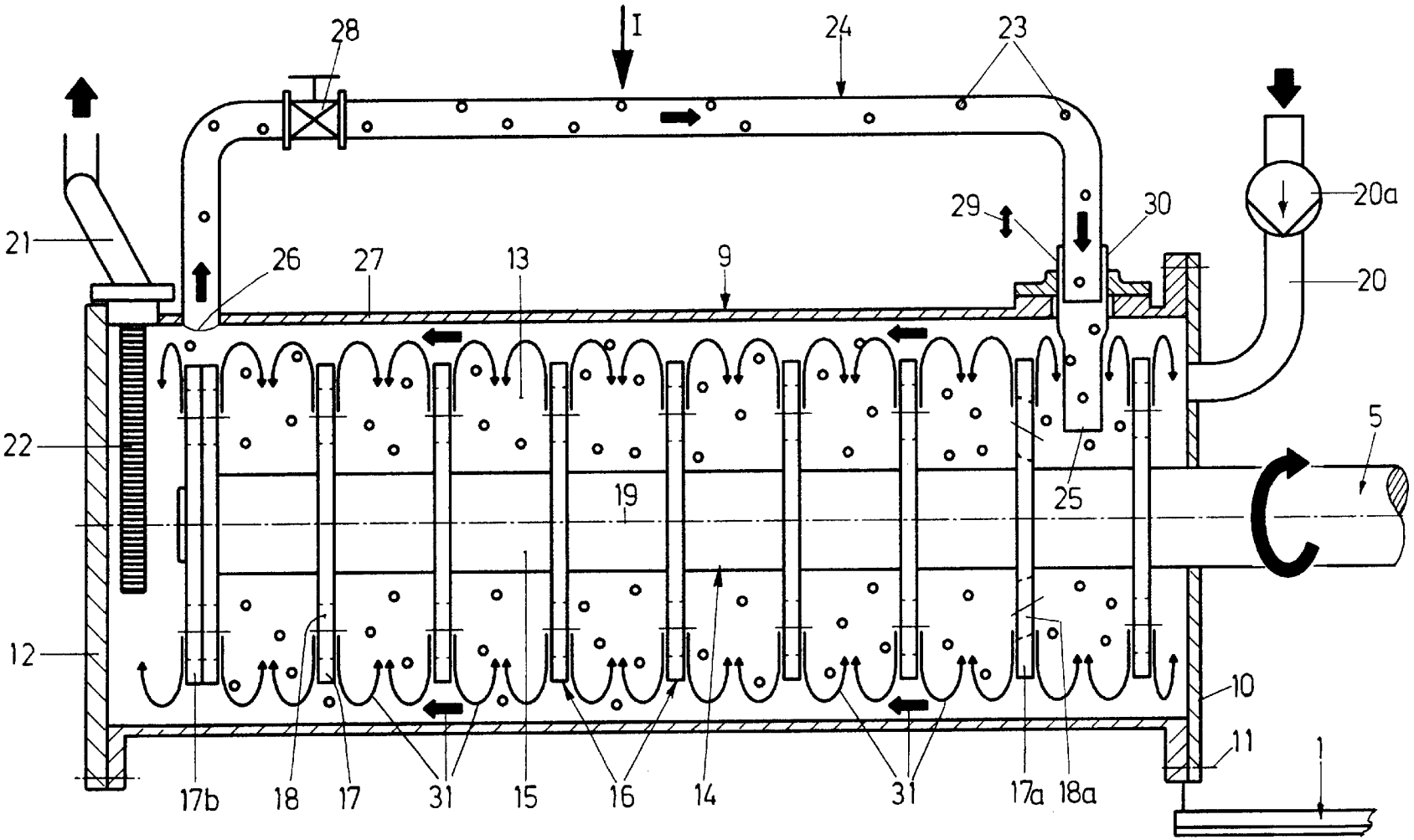
FIG. 2 is a partial illustration of the agitator mill in a vertical section corresponding to the section line II—II in FIG. 1.

In the embodiment according to FIGS. 1 and 2, the outlet 26 of the auxiliary-grinding-body return line 24 is directly beside the connection of the discharge line 21 to the separating device 22 i.e. in vicinity to the bottom 12. The inlet 25 of the return line 24 is situated between the two agitator disks 17 that neighbor the lid 10 and in vicinity to the direct neighborhood of the agitator shaft 15. So as to improve the introduction of the auxiliary grinding bodies 23 which pass from the inlet 25 of the return line 24 into the grinding chamber 13, the admission ports 18*a* in the agitator disk 17*a* are inclined toward the agitator shaft 15. The agitator disk 17*a* is the second agitator disk seen from the lid 10 and it is disposed in vicinity to the inlet 25 on the side turned toward the outlet 26.

For the possibility of moving the inlet 25 as close as possible to the agitator shaft 15, the return line 24 is designed, in this area, as a radial plunge pipe 30 which is displaceable crosswise to the axis 19 in the direction 29. Because of the circulation flow 31 which forms between adjacent agitator disks 17 (outlined in detail only in FIG. 2), the highest negative pressure in the grinding chamber 13 prevails in the proximity of the agitator shaft 15. The highest pressure in the grinding chamber 13 prevails at the periphery, i.e. in the vicinity of the wall 27. This applies in particular to the area radial around the agitator disk 17. For this reason the last agitator disk 17*b*, relative to which the outlet 26 of the return line 24 is disposed radially, is twice as thick as the other agitator disks 17, i.e. it has twice the axial extension.

Figure 3:
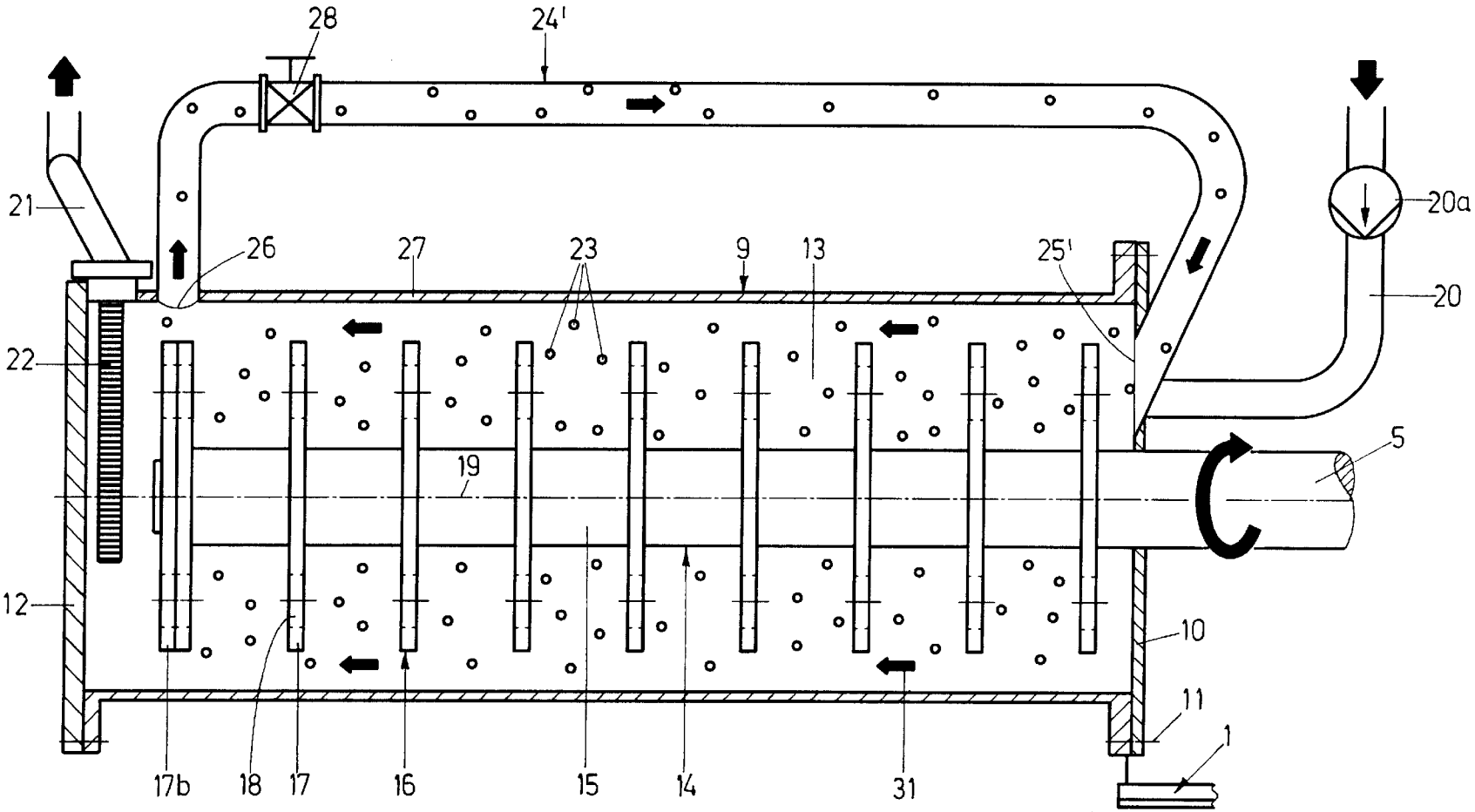
FIG. 3 is an illustration corresponding to FIG. 2 of a second embodiment of an agitator mill.

The embodiment according to FIG. 3 differs from that according to FIG. 2 substantially only in that the return line 24' opens into the grinding chamber 13 through the lid 10', the inlet 25' directly neighboring the agitator shaft 15. The supply line 20 opens further outwards into the grinding chamber 13. Otherwise, all the reference numerals in FIG. 3 have the same meaning as in FIG. 2 so that reference can be made to the above description.

Figure 4:
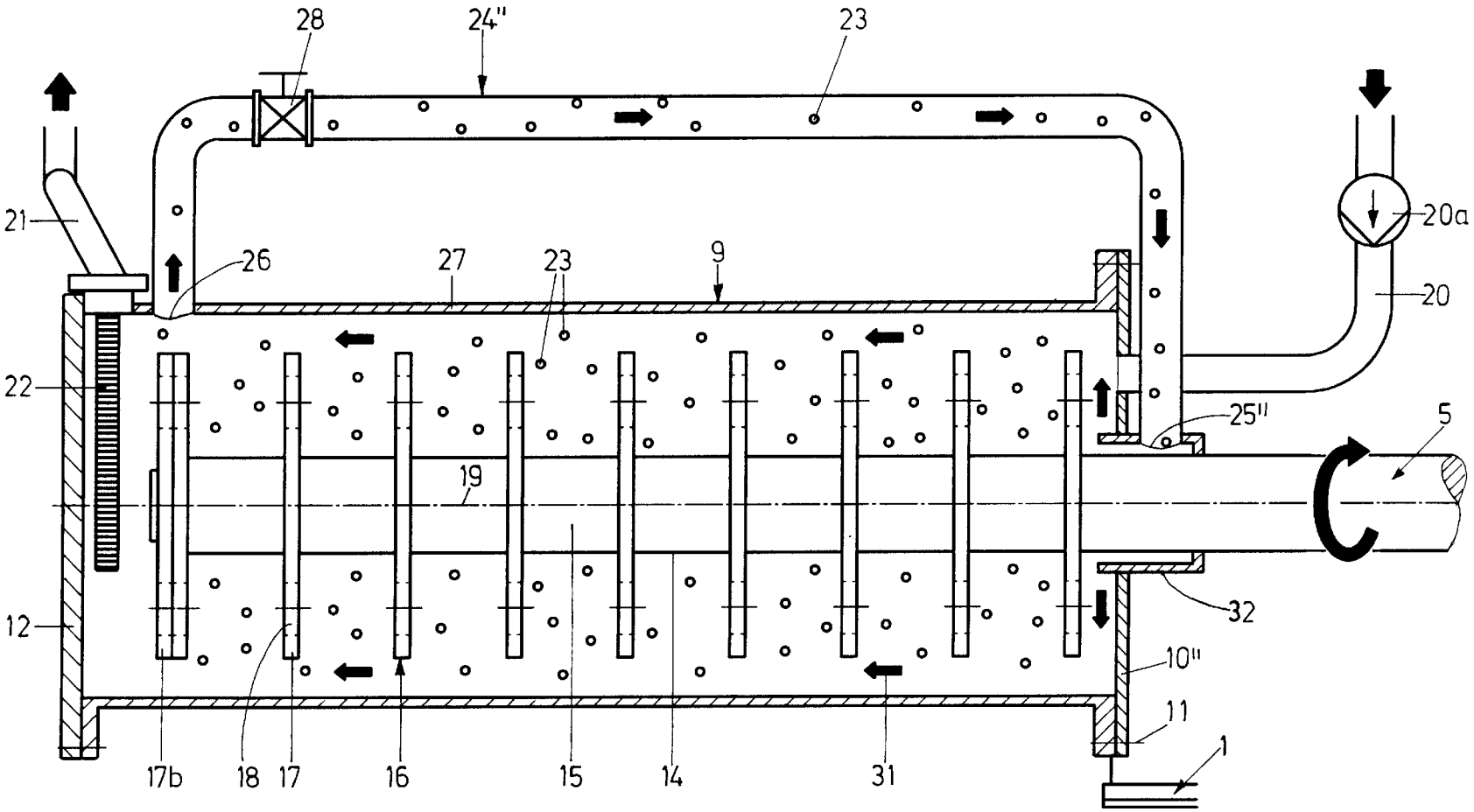
FIG. 4 is an illustration corresponding to FIGS. 2 and 3 of a third embodiment of an agitator mill.

In the embodiment according to FIG. 4, the auxiliary-grinding-body return line 24" opens into a cup-shaped connector 32 which is open towards the grinding chamber 13 and mounted in the lid 10", passing there-through and encircling the agitator shaft 15. In this case too, the inlet 25" directly neighbors the agitator shaft 15, i.e. it is in an area of high local negative pressure. The above description applies in this case too.

Figure 5:
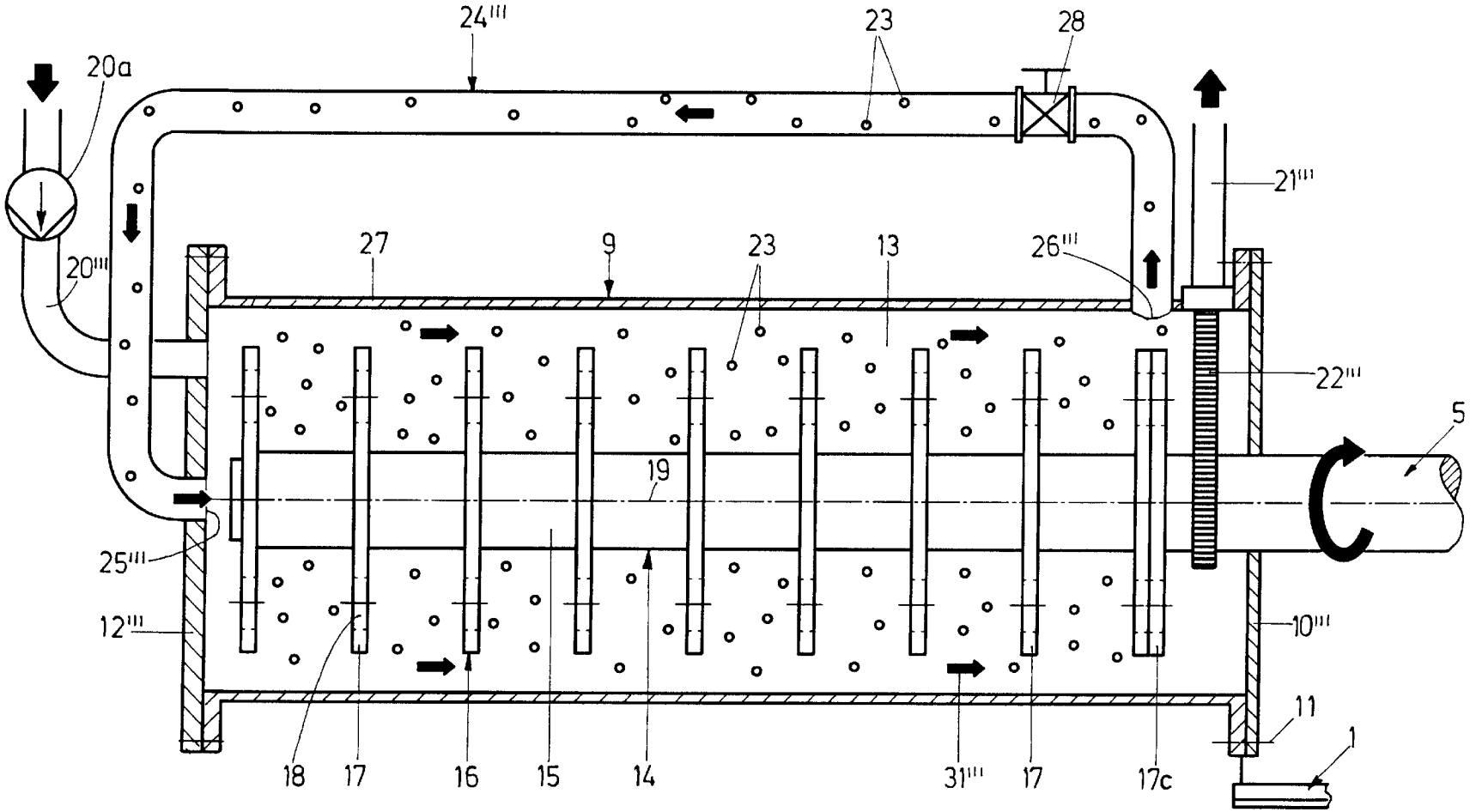
FIG. 5 is an illustration corresponding to FIGS. 2 to 4 of a fourth embodiment of an agitator mill.

In the embodiment according to FIG. 5, the grinding-stock supply line 20'" opens through the bottom 12'" into the grinding chamber 13, whereas the separating device 22'" is situated in the proximity of the lid 10'" where it is joined to the grinding-stock discharge line 21'". In this case, the separating device 22'" comprises at least two screen cartridges which are disposed on either side of the agitator shaft 15 and guided alongside thereof. The outlet 26'" of the auxiliary-grinding-body return line 24'" directly neighbors the separating device 22'". Correspondingly, the agitator disk 17*c* which is closest to the lid 10'" is thicker than the other agitator disks 17. The inlet 25'" of the return line 24'" sits in the bottom 12'" concentrically of the axis 19. The grinding stock flows through the grinding chamber 13 in a direction opposite to that in the embodiments of FIGS. 2 to 4, a circulation flow 31'" forming between adjacent agitator disks 17. Here too the above description applies as far as identical reference numerals are used.

In all the embodiments the grinding stock to be ground is introduced by the pump 20*a* through the grinding-stock supply line 20, 20'" into the grinding chamber 13, through which it is subsequently transported together with the auxiliary grinding bodies, the high-speed rotation of the agitator 14 customarily effecting a dispersion and comminution of the grinding stock which is present in a free-flowing suspension. The grinding stock is discharged through the separating device 22 and 22'". Due to the comparatively high pressure prevailing in the vicinity of the outlet 26 and 26'", the auxiliary grinding bodies 23 and part of the grinding stock are pressed through the outlet 26 and 26'" into the auxiliary-grinding-body return line 24, 24', 24", 24'"; due to the pressure difference prevailing between the outlet 26, 26'" and the inlet 25, 25', 25", 25'", they flow through the return line 24, 24', 24", 24'" towards the inlet 25, 25', 25", 25'". This transport conditioned by the pressure difference ensures a very stable and continuous circulation of the auxiliary grinding bodies.

Although the embodiments described only illustrate agitator mills with a horizontal axis 19, the measures according to the invention are also applicable for agitator mills that have a vertical axis. In this case, the drive shaft 5 and the agitator 14 would pass from above into the grinding chamber 9. The grinding-stock supply line 20, 20'" would open from below into the grinding receptacle 9. The separating device 22, 22' would sit at the top in the grinding receptacle 9, i.e. in the vicinity of where the drive shaft 6 enters. The auxiliary-grinding-body return line 24, 24', 24", 24'" would discharge from the grinding receptacle 9 at the top in vicinity to the separating device 22, 22'" and correspondingly open into it at the bottom. Fundamentally the arrangement would be the same as seen in FIG. 5.

What is claimed is:

1. An agitator mill comprising:

a grinding receptacle (9), a cylindrical wall (27) and a lid (10, 10', 10", 10'") and a bottom (12, 12'") of which define a grinding chamber (13) to be filled with auxiliary grinding bodies (23), and which has an axis (19); an agitator (14), which is disposed in the grinding receptacle (9) and has an agitator shaft (15) and agitator elements (16) mounted thereon; a drive motor (2) for driving the agitator (14) in rotation about said axis (19);

a grinding-stock supply line (20, 20'"), which is provided with a pump (20*a*) and which is disposed at least in vicinity to one of the lid (10, 10', 10") and the bottom (12'") and has an opening into the grinding chamber (13)at which the pump (20*a*) produces a high pressure;

a grinding-stock/auxiliary-grinding-body separating device (22, 22'"), which is disposed at least in vicinity to one of the bottom (12) and the lid (10'") and opens into a grinding-stock discharge line (21, 21'"); and an auxiliary-grinding-body return line (24, 24', 24", 24'"), which is separate from the grinding-stock supply line (20, 20'"), which comprises an outlet (26, 26") from the grinding chamber (13) in the vicinity of the cylindrical wall in a portion of local excess pressure and neighboring the separating device (22, 22'"), and which comprises an inlet (25, 25', 25", 25'") into the grinding chamber (13) which in reference to a radial direction from the axis (19) is arranged in vicinity to the agitator shaft (15) in a portion of local negative pressure in comparison to the excess pressure at the outlet (26, 26") and the high pressure at the opening of the return line and neighbors the inlet of the grinding-stock supply line (20, 20'") in the direction of the axis (19).

2. An agitator mill according to claim 1, wherein the inlet (25) of the auxiliary-grinding-body return line (24) is formed on a plunge pipe (30) which constitutes a section of the auxiliary-grinding-body return line (24) and which is disposed between agitator elements (16) neighboring and spaced in the direction of the axis (19).

3. An agitator mill according to claim 2, wherein the plunge pipe (30) is displaceable such that the distance of the inlet (25) from the agitator shaft (15) is adjustable.

4. An agitator mill according to claim 1, wherein the inlet (25') of the auxiliary-grinding-body return line (24') is formed in the lid (10').

5. An agitator mill according to claim 1, wherein the inlet (25") of the auxiliary-grinding-body return line (24") is disposed outside the grinding chamber (13) in a connector (32) which is joined to the grinding chamber (13), passes through the lid (10") and encircles the agitator shaft (15).

6. An agitator mill according to claim 1, wherein the inlet (25'") of the auxiliary-grinding-body return line (24'") into the grinding chamber (13) is disposed in the bottom (12'") concentrically of the axis (19).

7. An agitator mill according to claim 1, wherein at least one agitator element (16) is disposed in vicinity to the outlet (26, 26'") of the auxiliary-grinding-body return line (24, 24', 24", 24'").

8. An agitator mill according to claim 1, wherein the axis (19) of the grinding receptacle (9) is horizontal.

9. An agitator mill according to claim 1, wherein related to the axis (19), the inlet (25, 25', 25", 25'") is radially closer to the agitator shaft (15) than the inlet of the grinding-stock supply line (20, 20'") into the grinding chamber (13).

10. An agitation mill according to claim 1, wherein the local negative pressure at the inlet, the excess pressure at the outlet and the high-pressure at the opening relative to each other is produced in part by spacing between the inlet, the outlet and the opening.

11. An agitator mill comprising:

a grinding receptacle (9), a cylindrical wall (27) and a lid (10) and a bottom (12) of which define a grinding chamber (13) to be filled with auxiliary grinding bodies (23), and which has an axis (19); an agitator (14), which is disposed in the grinding receptacle (9) and has an agitator shaft (15) and agitator elements (16) mounted thereon; a drive motor (2) for driving the agitator (14) in rotation about said axis (19);

a grinding-stock supply line (20), which is disposed at least in a vicinity to one of the lid (10) and the bottom and has an opening into the grinding chamber (13) at which the pump (20*a*) produces a high pressure;

a grinding-stock/auxiliary-grinding-body separating device (22), which is disposed at least in vicinity to one of the bottom (12) and the lid and opens into a grinding-stock discharge line (21); and an auxiliary-grinding-body return line (24), which is separate from the grinding-stock supply line (20), which comprises an outlet (26) from the grinding chamber (13) in the vicinity of the cylindrical wall in a portion of local excess pressure and neighboring the separating device (22), and which comprises an inlet (25) into the grinding chamber (13) which in reference to a radial direction from the axis (19) is arranged in vicinity to the agitator shaft (15) in a portion of local negative pressure in comparison to the excess pressure at the outlet (26) and the high pressure at the opening of the return line and neighbors the inlet of the grinding-stock supply line (20) in the direction of the axis (19);

wherein the inlet (25) of the auxiliary-grinding-body return line (24) is formed on a plunge pipe (30) which constitutes a section of the auxiliary-grinding-body return line (24) and which is disposed between agitator elements (16) neighboring and spaced in the direction of the axis (19).

12. An agitator mill comprising:

a grinding receptacle (9), a cylindrical wall (27) and a lid (10) and a bottom (12) of which define a grinding chamber (13) to be filled with auxiliary grinding bodies (23), and which has an axis (19); an agitator (14), which is disposed in the grinding receptacle (9) and has an agitator shaft (15) and agitator elements (16) mounted thereon; a drive motor (2) for driving the agitator (14) in rotation about said axis (19);

a grinding-stock supply line (20), which is disposed at least in a vicinity to one of the lid (10) and the bottom and has an opening into the grinding chamber (13) at which the pump (20*a*) produces a high pressure;

a grinding-stock/auxiliary-grinding-body separating device (22), which is disposed at least in vicinity to one of the bottom (12) and the lid and opens into a grinding-stock discharge line (21); and an auxiliary-grinding-body return line (24), which is separate from the grinding-stock supply line (20), which comprises an outlet (26) from the grinding chamber (13) in the vicinity of the cylindrical wall in a portion of local excess pressure and neighboring the separating device (22), and which comprises an inlet (25) into the grinding chamber (13) radial to the axis (19) in vicinity to the agitator shaft (15) neighboring the inlet of the grinding-stock supply line (20) in the direction of the axis (19);

wherein the inlet (25) of the auxiliary-grinding-body return line (24) is formed on a plunge pipe (30) which constitutes a section of the auxiliary-grinding-body return line (24) and which is disposed between agitator elements (16) neighboring and spaced in the direction of the axis (19).

* * * * *